US006385991B1

(12) United States Patent
Romanosky

(10) Patent No.: US 6,385,991 B1
(45) Date of Patent: May 14, 2002

(54) REFRIGERATION APPARATUS

(76) Inventor: Marcia K. Romanosky, 2411-47 Lake Ave. Box 5042, North Muskegon, MI (US) 49445

( * ) Notice: Subject to any disclaimer, the term of this patent is extended or adjusted under 35 U.S.C. 154(b) by 0 days.

(21) Appl. No.: 09/853,496

(22) Filed: May 11, 2001

(51) Int. Cl.[7] ..... F25D 11/00
(52) U.S. Cl. ..... 62/440; 62/381
(58) Field of Search ..... 62/440, 449, 443, 62/246, 381, 457.1, 457.5, 457.7, 457.9

(56) References Cited

U.S. PATENT DOCUMENTS

| | | | | |
|---|---|---|---|---|
| 2,139,441 A | * | 12/1938 | Clarke | 62/89 |
| 2,715,817 A | * | 8/1955 | Brodheim | 62/116 |
| 3,708,997 A | * | 1/1973 | McLaughlin | 62/449 |
| 3,732,702 A | | 5/1973 | Desch | |
| 4,584,847 A | | 4/1986 | Martello et al. | |
| 4,706,472 A | | 11/1987 | Howard | |
| 4,892,226 A | | 1/1990 | Abtahi | |
| D354,064 S | | 1/1995 | Sims | |
| 5,524,440 A | | 6/1996 | Nishioka et al. | |

* cited by examiner

*Primary Examiner*—Denise L. Esquivel
*Assistant Examiner*—Melvin Jones

(57) ABSTRACT

A refrigeration apparatus for allowing a user to keep cosmetic items cool and protected from the environment. The refrigeration apparatus includes a housing having a plurality of walls that defines an interior space. A first of a pair of end walls has an aperture for permitting access to the interior space of the housing. The interior space is adapted for storing cosmetics and medicines. A cover is for selectively covering the aperture through the first of the end walls. A refrigeration assembly is coupled to a second of the end walls. A turntable is rotatably coupled to a bottom wall of the housing. The turntable is positioned within the interior space of the housing. The turntable is adapted for rotating cosmetics and medicines between a rear of the housing and a front of the housing when the turntable is rotated by a user.

19 Claims, 2 Drawing Sheets

REFRIGERATION APPARATUS

BACKGROUND OF THE INVENTION

1. Field of the Invention

The present invention relates to refrigeration apparatuses and more particularly pertains to a new refrigeration apparatus for allowing a user to keep cosmetic items cool and protected from the environment.

2. Description of the Prior Art

The use of refrigeration apparatuses is known in the prior art. More specifically, refrigeration apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,524,440; U.S. Pat. No. 4,892,226; U.S. Pat. No. 4,706,472; U.S. Pat. No. 3,732,702; U.S. Pat. No. 4,584,847; and U.S. Pat. No. Des. 354,064.

While these devices fulfill their respective, particular objectives and requirements, the aforementioned patents do not disclose a new refrigeration apparatus. The inventive device includes a housing has a plurality of walls that defines an interior space. The plurality of walls includes a pair of end walls. A first of the end walls has an aperture through the first of the end walls such that the aperture permits access to the interior space of the housing. The interior space is adapted for storing the cosmetics and medicines. A cover is coupled to the first of the ends. The cover is for selectively covering the aperture through the first of the end walls. A refrigeration assembly is coupled to a second of the end walls opposite the first of the end walls. The refrigeration assembly is for cooling and maintaining a predetermined temperature within the interior space of the housing for keeping the cosmetics and medicines cool. A turntable is rotatably coupled to a bottom wall of the housing. The turntable is positioned within the interior space of the housing. The turntable is adapted for rotating cosmetics and medicines between a rear of the housing and a front of the housing when the turntable is rotated by a user.

In these respects, the refrigeration apparatus according to the present invention substantially departs from the conventional concepts and designs of the prior art, and in so doing provides an apparatus primarily developed for the purpose of to allow a user to keep cosmetic items cool and protected from the environment.

SUMMARY OF THE INVENTION

In view of the foregoing disadvantages inherent in the known types of refrigeration apparatuses now present in the prior art, the present invention provides a new refrigeration apparatus construction wherein the same can be utilized for allowing a user to keep cosmetic items cool and protected from the environment.

The general purpose of the present invention, which will be described subsequently in greater detail, is to provide a new refrigeration apparatus apparatus and method which has many of the advantages of the refrigeration apparatuses mentioned heretofore and many novel features that result in a new refrigeration apparatus which is not anticipated, rendered obvious, suggested, or even implied by any of the prior art refrigeration apparatuses, either alone or in any combination thereof.

To attain this, the present invention generally comprises a housing has a plurality of walls that defines an interior space.

The plurality of walls includes a pair of end walls. A first of the end walls has an aperture through the first of the end walls such that the aperture permits access to the interior space of the housing. The interior space is adapted for storing the cosmetics and medicines. A cover is coupled to the first of the ends. The cover is for selectively covering the aperture through the first of the end walls. A refrigeration assembly is coupled to a second of the end walls opposite the first of the end walls. The refrigeration assembly is for cooling and maintaining a predetermined temperature within the interior space of the housing for keeping the cosmetics and medicines cool. A turntable is rotatably coupled to a bottom wall of the housing. The turntable is positioned within the interior space of the housing. The turntable is adapted for rotating cosmetics and medicines between a rear of the housing and a front of the housing when the turntable is rotated by a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new refrigeration apparatus apparatus and method which has many of the advantages of the refrigeration apparatuses mentioned heretofore and many novel features that result in a new refrigeration apparatus which is not anticipated, rendered obvious, suggested, or even implied by any of the prior art refrigeration apparatuses, either alone or in any combination thereof.

It is another object of the present invention to provide a new refrigeration apparatus, which may be easily and efficiently manufactured and marketed.

It is a further object of the present invention to provide a new refrigeration apparatus, which is of a durable and reliable construction.

An even further object of the present invention is to provide a new refrigeration apparatus which is susceptible of a low cost of manufacture with regard to both materials and labor, and which accordingly is then susceptible of low prices of sale to the consuming public, thereby making such refrigeration apparatus economically available to the buying public.

Still yet another object of the present invention is to provide a new refrigeration apparatus which provides in the apparatuses and methods of the prior art some of the advantages thereof, while simultaneously overcoming some of the disadvantages normally associated therewith.

Still another object of the present invention is to provide a new refrigeration apparatus for allowing a user to keep cosmetic items cool and protected from the environment.

Yet another object of the present invention is to provide a new refrigeration apparatus which includes a housing that has a plurality of walls that defines an interior space. The plurality of walls includes a pair of end walls. A first of the end walls has an aperture through the first of the end walls such that the aperture permits access to the interior space of the housing. The interior space is adapted for storing the cosmetics and medicines. A cover is coupled to the first of the ends. The cover is for selectively covering the aperture through the first of the end walls. A refrigeration assembly is coupled to a second of the end walls opposite the first of the end walls. The refrigeration assembly is for cooling and maintaining a predetermined temperature within the interior space of the housing for keeping the cosmetics and medicines cool. A turntable is rotatably coupled to a bottom wall of the housing. The turntable is positioned within the interior space of the housing. The turntable is adapted for rotating cosmetics and medicines between a rear of the housing and a front of the housing when the turntable is rotated by a user.

Still yet another object of the present invention is to provide a new refrigeration apparatus that would help cosmetics such as nail polish last longer. The present invention would also help other types of cosmetics from becoming contaminated by keeping them cold and solid.

Even still another object of the present invention is to provide a new refrigeration apparatus that save the user money by eliminating the premature replacement of expensive cosmetics.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
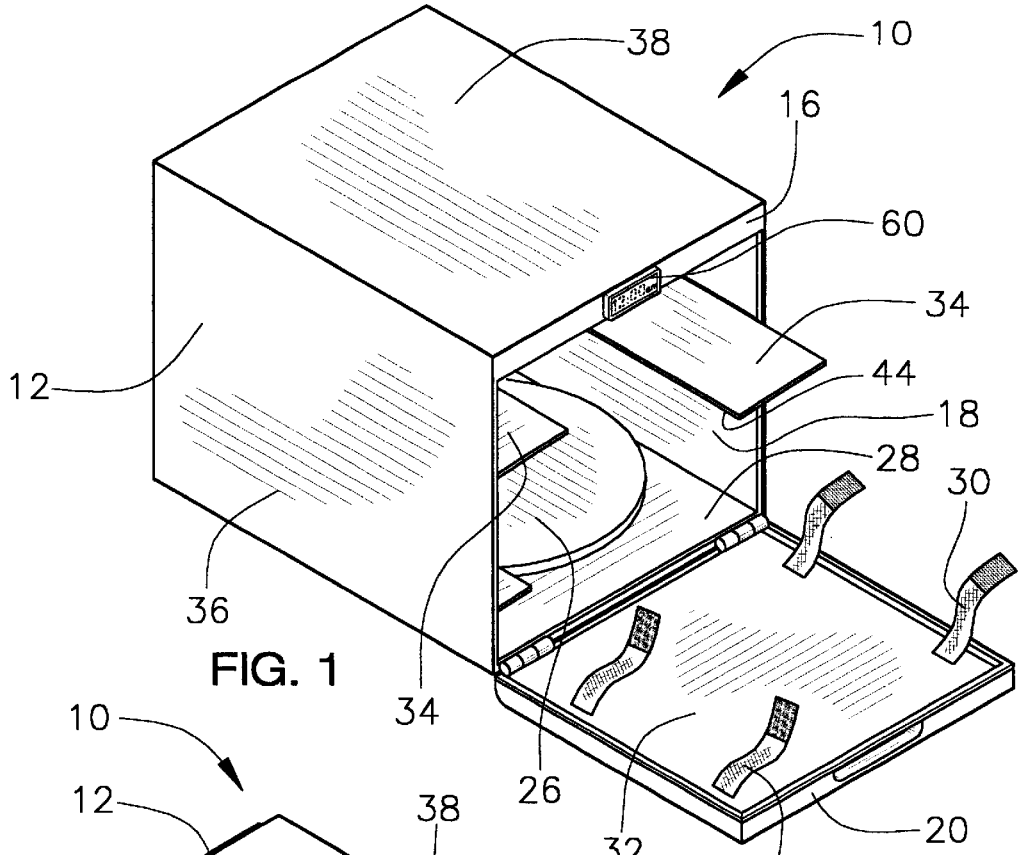
FIG. 1 is a perspective view of a new refrigeration apparatus according to the present invention.
Figure 2:
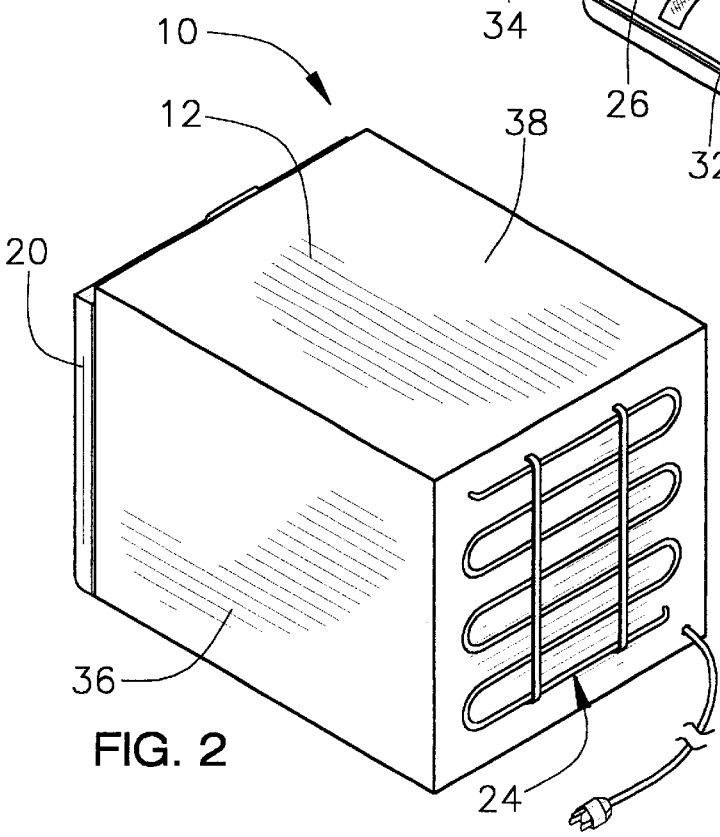
FIG. 2 is a perspective view of the present invention.
Figure 3:
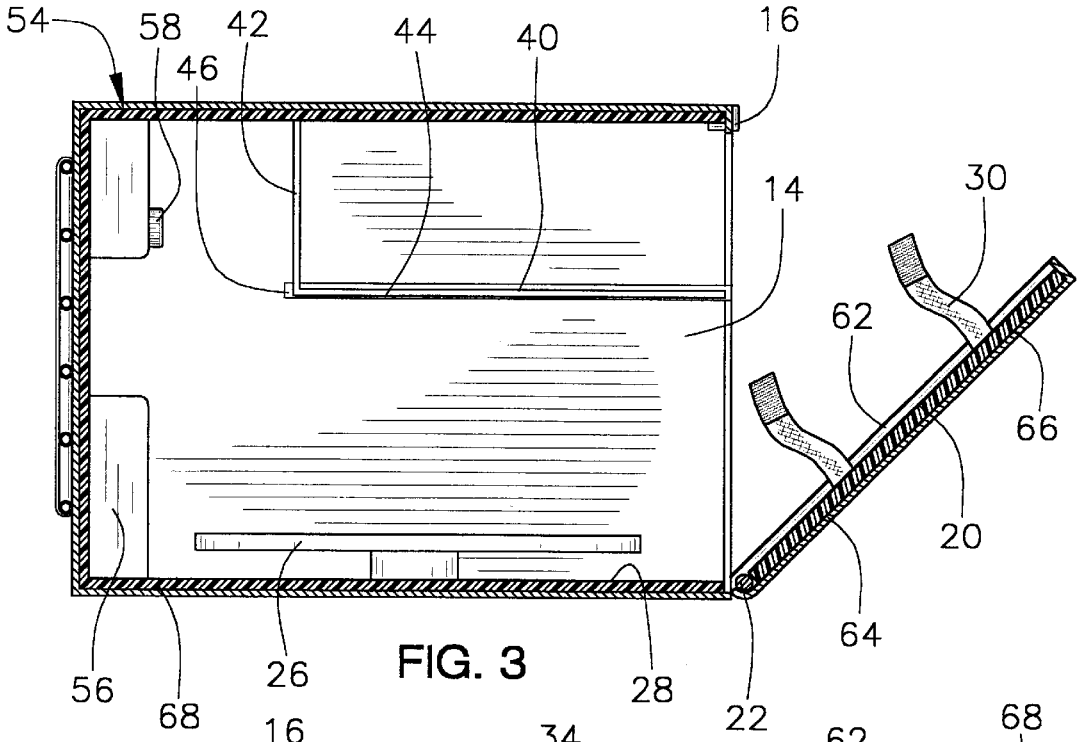
FIG. 3 is a side view of the present invention.
Figure 4:
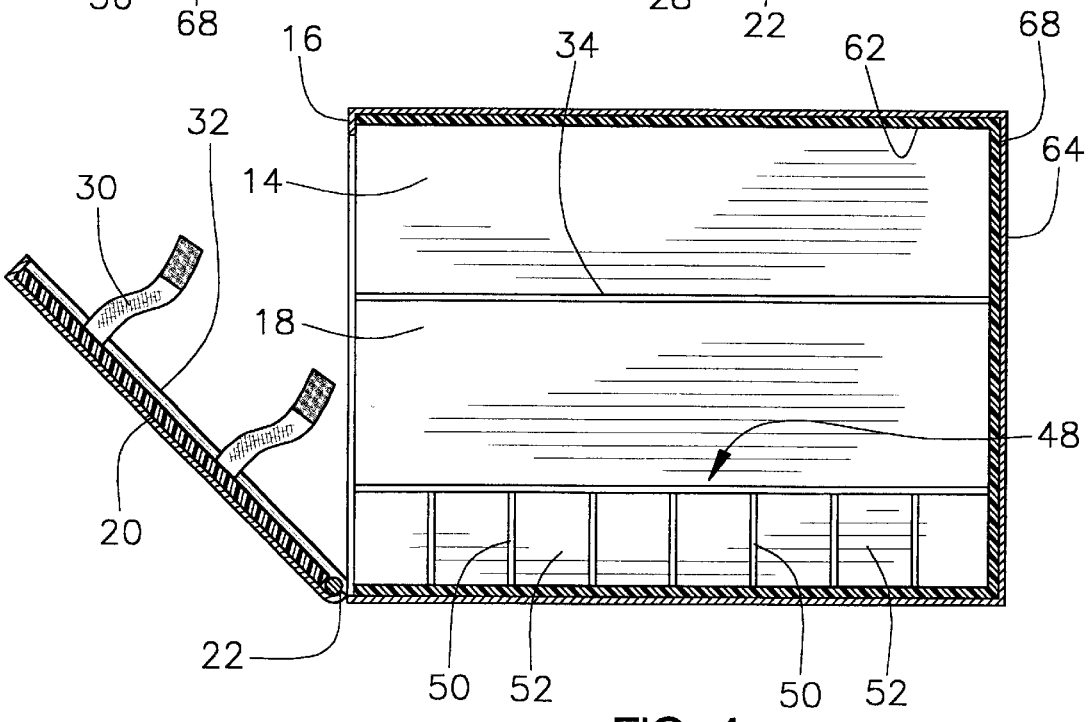
FIG. 4 is a side view of the present invention.

With reference now to the drawings, and in particular to FIGS. 1 through 4 thereof, a new refrigeration apparatus embodying the principles and concepts of the present invention and generally designated by the reference numeral 10 will be described.

As best illustrated in FIGS. 1 through 4, the refrigeration apparatus 10 generally includes a housing 12 has a plurality of walls that defines an interior space 14. The plurality of walls includes a pair of end walls 16. A first of the end walls 16 has an aperture 18 through the first of the end walls 16 such that the aperture 18 permits access to the interior space 14 of the housing 12. The interior space 14 is adapted for storing the cosmetics and medicines. A cover 20 is coupled to the first of the ends. The cover 20 is for selectively covering the aperture 18 through the first of the end walls 16. A refrigeration assembly 24 is coupled to a second of the end walls 22 opposite the first of the end walls 16. The refrigeration assembly 24 is for cooling and maintaining a predetermined temperature within the interior space 14 of the housing 12 for keeping the cosmetics and medicines cool. A turntable 26 is rotatably coupled to a bottom wall 28 of the housing 12. The turntable 26 is positioned within the interior space 14 of the housing 12. The turntable 26 is adapted for rotating cosmetics and medicines between a rear of the housing 12 and a front of the housing 12 when the turntable 26 is rotated by a user.

A plurality of straps 30 is coupled to an interior surface 32 of the cover 20. The straps 30 are releasably coupled to each other such that the straps 30 are adapted for securing the cosmetics and medicine to the cover 20.

A plurality of shelves 34 each is coupled to one of a pair of side walls 36 of the housing 12. Each of the shelves 34 are positioned within the interior space 14 of the housing 12 and proximate a top wall 38 of the housing 12. The shelves 34 are adapted for storing the cosmetics and the medicines. At least one of the shelves 34 has a base portion 40 and a backing portion 42. The backing portion 42 is coupled to an end of the base portion 40 such that the backing portion 42 extends between the base portion 40 and the top wall 38 of the housing 12. The backing portion 42 is adapted for preventing the cosmetics and medicines from is inadvertently pushed off of the end of the base portion 40. The base portion 40 has a side edge 44 for slidably engaging a channel 46 in one of the side walls 36 adjacent the base portion 40 of the respective one of the shelves 34. The respective one of the shelves 34 is for sliding out of the interior space 14 of the housing 12 for facilitating access to the respective one of the shelves 34.

A partition assembly 48 is positioned adjacent the bottom wall 28 and one of a pair of side walls 36 of the housing 12 such that the partition assembly 48 is positioned within the interior space 14 of the housing 12. The partition assembly 48 is adapted for holding bottles of cosmetics and medicines. The partition assembly 48 has a plurality of partitions 50 that are positioned along the bottom wall 28 of the housing 12. The partitions 50 forming a plurality of compartments 52, each of the compartments 52 are adapted for holding one of the bottles.

The refrigeration assembly includes a temperature control assembly 54 that is coupled within the interior space 14 of the housing 12. The temperature control assembly 54 is for monitoring a temperature within the interior space 14 of the housing 12 such that the temperature control actuates a cooling apparatus 56 to reduce the temperature within the interior space 14. The temperature control has an adjustment control 58. The adjustment control 58 is for adjusting a predetermined temperature at which the temperature control 58 keeps the temperature within the interior space 14. The adjustment control 58 is adapted for facilitating adjustment of the predetermined temperature by the user. A clock 60 is coupled to the first of the end walls 16.

Each of the walls and the cover 20 has an interior portion 62 and an exterior portion 64. The exterior portion 64 of the walls and the cover 20 includes a rigid material 66. The rigid material 66 is for maintaining structural integrity of the housing 12 and the cover 20. The interior portion 62 of the walls and the cover 20 includes an insulating material 68. The insulating material 68 is for insulating said interior space 14 of the housing 12.

In use, a user would open the door to the present invention and store the cosmetic items on the shelf inside. The user would then close the door on the present invention and the cosmetics would remain safely inside until they are ready to use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refrigeration apparatus for keeping cosmetics and medicines cool, the refrigeration apparatus comprising:

a housing having a plurality of walls defining an interior space, said plurality of walls including a pair of end walls, a first of said end walls having an aperture through said first of said end walls such that said aperture permits access to said interior space of said housing, said interior space being adapted for storing the cosmetics and medicines;

a cover being coupled to said first of said ends, said cover being for selectively covering said aperture through said first of said end walls;

a refrigeration assembly being coupled a second of said end walls opposite said first of said end walls, said refrigeration assembly being for cooling and maintaining a predetermined temperature within said interior space of said housing for keeping the cosmetics and medicines cool;

a turntable being rotatably coupled to a bottom wall of said housing, said turntable being positioned within said interior space of said housing, said turntable being adapted for rotating cosmetics and medicines between a rear of said housing and a front of said housing when said turntable is rotated by a user; and a plurality of straps being coupled to an interior surface of said cover, said straps being releasably coupled to each other such that said straps are adapted for securing the cosmetics and medicine to said cover.

2. The refrigeration apparatus as set forth in claim 1, further comprises:

a plurality of shelves each being coupled to one of a pair of side walls of said housing, each of said shelves being positioned within said interior space of said housing and proximate a top wall of said housing, said shelves being adapted for storing the cosmetics and the medicines.

3. The refrigeration apparatus as set forth in claim 2, wherein at least one of said shelves has a base portion and a backing portion, said backing portion being coupled to an end of said base portion such that said backing portion extends between said base portion and said top wall of said housing, said backing portion being adapted preventing the cosmetics and medicines from being inadvertently pushed off of said end of said base portion.

4. The refrigeration apparatus as set forth in claim 3, wherein said base portion has a side edge for slidably engaging a channel in one of said side walls adjacent said base portion of said respective one of said shelves, said respective one of said shelves being for sliding out of said interior space of said housing for facilitating access to said respective one of said shelves.

5. The refrigeration apparatus as set forth in claim 1, further comprising:

a partition assembly being positioned adjacent said bottom wall and one of a pair of side walls of said housing such that said partition assembly is positioned within said interior space of said housing, said partition assembly being adapted for holding bottles of cosmetics and medicines.

6. The refrigeration apparatus as set forth in claim 5, wherein said partition assembly has a plurality of partitions being positioned along said bottom wall of said housing, said partitions forming a plurality of compartments, each of said compartments being adapted for holding one of the bottles.

7. The refrigeration apparatus as set forth in claim 1, wherein said refrigeration assembly includes a temperature control assembly being coupled within said interior space of said housing, said temperature control assembly being for monitoring a temperature within said interior space of said housing such that said temperature control actuates a cooling apparatus to reduce the temperature within said interior space.

8. The refrigeration apparatus as set forth in claim 7, wherein said temperature control has an adjustment control, said adjustment control being for adjusting a predetermined temperature at which said temperature control keeps the temperature within said interior space, said adjustment control being adapted for facilitating adjustment of said predetermined temperature by the user.

9. The refrigeration apparatus as set forth in claim 1, further comprising:

a clock being coupled to said first of said end walls.

10. The refrigeration apparatus as set forth in claim 1, wherein each of said walls and said cover has an interior portion and an exterior portion, said exterior portion of said walls and said cover comprising a rigid material, said rigid material being for maintaining structural integrity of said housing and said cover, said interior portion of said walls and said cover comprising an insulating material, said insulating material being for insulating said interior space of said housing.

11. A refrigeration apparatus for keeping cosmetics and medicines cool, the refrigeration apparatus comprising:

a housing having a plurality of walls defining an interior space, said plurality of walls including a pair of end walls, a first of said end walls having an aperture through said first of said end walls such that said aperture permits access to said interior space of said housing, said interior space being adapted for storing the cosmetics and medicines;

a cover being coupled to said first of said ends, said cover being for selectively covering said aperture through said first of said end walls;

a refrigeration assembly being coupled a second of said end walls opposite said first of said end walls, said refrigeration assembly being for cooling and maintaining a predetermined temperature within said interior space of said housing for keeping the cosmetics and medicines cool; and a turntable being rotatably coupled to a bottom wall of said housing, said turntable being positioned within said interior space of said housing, said turntable being adapted for rotating cosmetics and medicines between a rear of said housing and a front of said housing when said turntable is rotated by a user;

wherein a plurality of straps being coupled to an interior surface of said cover, said straps being releasably coupled to each other such that said straps are adapted for securing the cosmetics and medicine to said cover;

wherein a plurality of shelves each being coupled to one of a pair of side walls of said housing, each of said shelves being positioned within said interior space of said housing and proximate a top wall of said housing, said shelves being adapted for storing the cosmetics and the medicines;

wherein at least one of said shelves has a base portion and a backing portion, said backing portion being coupled to an end of said base portion such that said backing portion extends between said base portion and said top wall of said housing, said backing portion being adapted preventing the cosmetics and medicines from being inadvertently pushed off of said end of said base portion;

wherein said base portion has a side edge for slidably engaging a channel in one of said side walls adjacent said base portion of said respective one of said shelves, said respective one of said shelves being for sliding out of said interior space of said housing for facilitating access to said respective one of said shelves;

wherein a partition assembly being positioned adjacent said bottom wall and one of a pair of side walls of said housing such that said partition assembly is positioned within said interior space of said housing, said partition assembly being adapted for holding bottles of cosmetics and medicines;

wherein said partition assembly has a plurality of partitions being positioned along said bottom wall of said housing, said partitions forming a plurality of compartments, each of said compartments being adapted for holding one of the bottles;

wherein said refrigeration assembly includes a temperature control assembly being coupled within said interior space of said housing, said temperature control assembly being for monitoring a temperature within said interior space of said housing such that said temperature control actuates a cooling apparatus to reduce the temperature within said interior space;

wherein said temperature control has an adjustment control, said adjustment control being for adjusting a predetermined temperature at which said temperature control keeps the temperature within said interior space, said adjustment control being adapted for facilitating adjustment of said predetermined temperature by the user;

a clock being coupled to said first of said end walls; and wherein each of said walls and said cover has an interior portion and an exterior portion, said exterior portion of said walls and said cover comprising a rigid material, said rigid material being for maintaining structural integrity of said housing and said cover, said interior portion of said walls and said cover comprising an insulating material, said insulating material being for insulating said interior space of said housing.

12. A refrigeration apparatus for keeping cosmetics and medicines cool, the refrigeration apparatus comprising:

a housing having a plurality of walls defining an interior space, said plurality of walls including a pair of end walls, a first of said end walls having an aperture through said first of said end walls such that said aperture permits access to said interior space of said housing, said interior space being adapted for storing the cosmetics and medicines;

a cover being coupled to said first of said ends, said cover being for selectively covering said aperture through said first of said end walls;

a refrigeration assembly being coupled a second of said end walls opposite said first of said end walls, said refrigeration assembly being for cooling and maintaining a predetermined temperature within said interior space of said housing for keeping the cosmetics and medicines cool;

a turntable being rotatably coupled to a bottom wall of said housing, said turntable being positioned within said interior space of said housing, said turntable being adapted for rotating cosmetics and medicines between a rear of said housing and a front of said housing when said turntable is rotated by a user;

a plurality of shelves each being coupled to one of a pair of side walls of said housing, each of said shelves being positioned within said interior space of said housing and proximate a top wall of said housing, said shelves being adapted for storing the cosmetics and the medicines; and at least one of said shelves having a base portion and a backing portion, said backing portion being coupled to an end of said base portion such that said backing portion extends between said base portion and said top wall of said housing, said backing portion being adapted preventing the cosmetics and medicines from being inadvertently pushed off of said end of said base portion.

13. The refrigeration apparatus as set forth in claim 12, wherein said base portion has a side edge for slidably engaging a channel in one of said side walls adjacent said base portion of said respective one of said shelves, said respective one of said shelves being for sliding out of said interior space of said housing for facilitating access to said respective one of said shelves.

14. A refrigeration apparatus for keeping cosmetics and medicines cool, the refrigeration apparatus comprising:

a housing having a plurality of walls defining an interior space, said plurality of walls including a pair of end walls, a first of said end walls having an aperture through said first of said end walls such that said aperture permits access to said interior space of said housing, said interior space being adapted for storing the cosmetics and medicines;

a cover being coupled to said first of said ends, said cover being for selectively covering said aperture through said first of said end walls;

a refrigeration assembly being coupled a second of said end walls opposite said first of said end walls, said refrigeration assembly being for cooling and maintaining a predetermined temperature within said interior space of said housing for keeping the cosmetics and medicines cool;

a turntable being rotatably coupled to a bottom wall of said housing, said turntable being positioned within said interior space of said housing, said turntable being adapted for rotating cosmetics and medicines between a rear of said housing and a front of said housing when said turntable is rotated by a user; and a partition assembly being positioned adjacent said bottom wall and one of a pair of side walls of said housing such that said partition assembly is positioned within said interior space of said housing, said partition assembly being adapted for holding bottles of cosmetics and medicines.

15. The refrigeration apparatus as set forth in claim 14, wherein said partition assembly has a plurality of partitions being positioned along said bottom wall of said housing, said partitions forming a plurality of compartments, each of said compartments being adapted for holding one of the bottles.

16. A refrigeration apparatus for keeping cosmetics and medicines cool, the refrigeration apparatus comprising:

a housing having a plurality of walls defining an interior space, said plurality of walls including a pair of end walls, a first of said end walls having an aperture through said first of said end walls such that said aperture permits access to said interior space of said housing, said interior space being adapted for storing the cosmetics and medicines;

a cover being coupled to said first of said ends, said cover being for selectively covering said aperture through said first of said end walls;

a refrigeration assembly being coupled a second of said end walls opposite said first of said end walls, said refrigeration assembly being for cooling and maintaining a predetermined temperature within said interior space of said housing for keeping the cosmetics and medicines cool;

a turntable being rotatably coupled to a bottom wall of said housing, said turntable being positioned within said interior space of said housing, said turntable being adapted for rotating cosmetics and medicines between a rear of said housing and a front of said housing when said turntable is rotated by a user; and said refrigeration assembly including a temperature control assembly being coupled within said interior space of said housing, said temperature control assembly being for monitoring a temperature within said interior space of said housing such that said temperature control actuates a cooling apparatus to reduce the temperature within said interior space.

17. The refrigeration apparatus as set forth in claim 16, wherein said temperature control has an adjustment control, said adjustment control being for adjusting a predetermined temperature at which said temperature control keeps the temperature within said interior space, said adjustment control being adapted for facilitating adjustment of said predetermined temperature by the user.

18. A refrigeration apparatus for keeping cosmetics and medicines cool, the refrigeration apparatus comprising:

a housing having a plurality of walls defining an interior space, said plurality of walls including a pair of end walls, a first of said end walls having an aperture through said first of said end walls such that said aperture permits access to said interior space of said housing, said interior space being adapted for storing the cosmetics and medicines;

a cover being coupled to said first of said ends, said cover being for selectively covering said aperture through said first of said end walls;

a refrigeration assembly being coupled a second of said end walls opposite said first of said end walls, said refrigeration assembly being for cooling and maintaining a predetermined temperature within said interior space of said housing for keeping the cosmetics and medicines cool;

a turntable being rotatably coupled to a bottom wall of said housing, said turntable being positioned within said interior space of said housing, said turntable being adapted for rotating cosmetics and medicines between a rear of said housing and a front of said housing when said turntable is rotated by a user; and a clock being coupled to said first of said end walls.

19. A refrigeration apparatus for keeping cosmetics and medicines cool, the refrigeration apparatus comprising:

a housing having a plurality of walls defining an interior space, said plurality of walls including a pair of end walls, a first of said end walls having an aperture through said first of said end walls such that said aperture permits access to said interior space of said housing, said interior space being adapted for storing the cosmetics and medicines;

a cover being coupled to said first of said ends, said cover being for selectively covering said aperture through said first of said end walls;

a refrigeration assembly being coupled a second of said end walls opposite said first of said end walls, said refrigeration assembly being for cooling and maintaining a predetermined temperature within said interior space of said housing for keeping the cosmetics and medicines cool;

a turntable being rotatably coupled to a bottom wall of said housing, said turntable being positioned within said interior space of said housing, said turntable being adapted for rotating cosmetics and medicines between a rear of said housing and a front of said housing when said turntable is rotated by a user; and each of said walls and said cover having an interior portion and an exterior portion, said exterior portion of said walls and said cover comprising a rigid material, said rigid material being for maintaining structural integrity of said housing and said cover, said interior portion of said walls and said cover comprising an insulating material, said insulating material being for insulating said interior space of said housing.

* * * * *